United States Patent [19]

Mal et al.

[11] 4,173,471

[45] Nov. 6, 1979

[54] AGE-HARDENABLE TITANIUM CARBIDE TOOL STEEL

[75] Inventors: M. Kumar Mal, Spring Valley; Stuart E. Tarkan, Monsey, both of N.Y.

[73] Assignee: Chromalloy American Corporation, West Nyack, N.Y.

[21] Appl. No.: 872,907

[22] Filed: Jan. 27, 1978

[51] Int. Cl.[2] ..... B22F 5/00; C22C 33/02; C22C 38/14; C22C 29/00

[52] U.S. Cl. ..... 75/237; 75/243

[58] Field of Search ..... 75/237, 243

[56] References Cited

U.S. PATENT DOCUMENTS 3,746,519 7/1973 Hara et al. ..... 75/243

3,809,540 5/1974 Mal ..... 75/237

*Primary Examiner*—Brooks H. Hunt

*Attorney, Agent, or Firm*—Hopgood, Calimafde, Kalil, Blaustein and Lieberman

[57] ABSTRACT

Relates to a sintered age-hardenable titanium carbide tool steel comprising by volume about 15% to 50% primary grains of titanium carbide dispersed through a high cobalt-containing steel matrix making up the balance, said matrix consisting essentially by weight of about 10% to 25% cobalt, about 5% to 20% chromium, about 0.5% to 5% molybdenum, 0 to 2% nickel, 0 to 0.15% carbon and essentially the balance at least about 50% iron.

4 Claims, No Drawings

AGE-HARDENABLE TITANIUM CARBIDE TOOL STEEL

This invention relates to age-hardenable, cobalt-containing titanium carbide tool steels and to die elements made of such steels having particular use in hot working applications.

STATE OF THE ART

Titanium carbide tool steel compositions are disclosed in U.S. Pat. No. 2,828,202 (assigned to the same assignee) comprising broadly primary grains of essentially titanium carbide distributed through a heat treatable steel matrix. A typical composition is one containing by weight 33% TiC in the form of primary carbide grains, dispersed through a steel matrix, the steel matrix containing by weight 3% Cr, 3% Mo, 0.6% C and the balance essentially iron. The steel is preferably produced using powder metallurgy methods which comprise broadly mixing powdered titanium carbide (primary carbide grains) with powdered steel-forming ingredients of, for example, the aforementioned composition, forming a compact by pressing the mixture in a mold and then subjecting the compact to liquid phase sintering under non-oxidizing conditions, such as in a vacuum. The term "primary carbide" employed herein is meant to cover the titanium carbide grains per se added directly in making up the composition and which grains are substantially unaffected by heat treatment.

In producing a titanium carbide tool steel composition containing, for example, about 33% by weight of TiC (approximately 45 volume percent) and substantially the balance a steel matrix, about 500 grams of TiC (of about 5 to 7 microns in size) are mixed with 1000 grams of steel-forming ingredients in a mill half filled with stainless steel balls. To the powder ingredients is added one gram of paraffin wax for each 100 grams of mix. The milling is conducted for about 40 hours, using hexane as a vehicle.

After completion of the milling, the mix is removed and dried and compacts of a desired shape pressed at about 15 tsi and the compacts then subjected to liquid phase sintering in vacuum at a temperature of about 2640° F. (1450° C.) for about one-half hour at a vacuum corresponding to 20 microns of mercury or better. After completion of the sintering, the compacts are cooled and then annealed by heating to about 1650° F. (900° C.) for 2 hours followed by cooling at a rate of about 27° F. (15° C.) per hour to about 212° F. (100° C.) and thereafter furnace cooled to room temperature to produce an annealed microstructure containing spheroidite. The annealed hardness is in the neighborhood of about 45 $R_C$ and the high carbon tool steel is capable of being machined and/or ground into any desired tool shape or machine part prior to hardening.

The hardening treatment comprises heating the machined piece to an austenitizing temperature of about 1750° F. for about one-quarter hour followed by quenching in oil to produce a hardness in the neighborhood of about 70 $R_C$.

While the foregoing typical composition has achieved some measure of commercial success, it has certain disadvantages. For example, when used as die material, under conditions in which heat is generated due to friction, or where the metal being worked upon has been preheated, over-tempering tended to occur, leading to softening of the die steel. In addition, unless care was taken to avoid rapid heating and cooling, a part made of the composition would be subject to thermal cracking. Moreover, the transverse rupture strength, while adequate for most uses, was not as high as desired, the transverse rupture strength usually ranging from about 250,000 psi to about 300,000 psi.

Another type of steel-bonded carbide is that disclosed in U.S. Pat. No. 3,653,982 (also assigned to the same assignee) a typical commercial composition being one containing by weight about 34.5% TiC as primary carbide grains dispersed through a steel matrix making up essentially the balance. The steel matrix contains by weight based on the matrix itself about 10% Cr, 3% Mo, 0.85% C and the balance essentially iron. This steel-bonded carbide differs from the aforementioned lower-chromium variety in that it is capable of being tempered at about 1000° F. (538° C.) and thus is capable of retaining fairly high hardness at such temperatures, particularly when used as an apex wear resistant seal strip in rotary piston engines, such as the Wankel engine. However, this composition, like the previously discussed composition, is subject to thermal shock and usually exhibits a transverse rupture strength ranging from about 250,000 psi to 300,000 psi. However, this steelbonded carbide is only capable of resisting softening up to about 950° F. or 1000° F. (510° C. or 538° C.) and, therefore, finds limited use as die material in certain hot working applications.

A steel-bonded carbide composition which exhibits resistance to softening at elevated temperatures is one covered by U.S. Pat. No. 3,053,706 (also assigned to the same assignee). A typical composition is one in which the refractory carbide is a solid solution carbide of the type $WTiC_2$ containing about 75% WC and 25% TiC. This carbide, preferably in an amount by weight of 45.6%, is dispersed through a steel matrix making up essentially the balance. The matrix which is capable of secondary hardening at 1000° F. to 1200° F. (538° C. to 650° C.) typically may contain 12% W, 5% Cr, 2% V, 0.85% C and the balance essentially iron. The dissolved tungsten in the matrix is in equilibrium with the saturated solution of the primary carbide. While the foregoing composition is satisfactory in providing the necessary secondary hardening effect to resist tempering at warm die-working temperatures, these compositions tended to be porous. For example, as pointed out in column 4 of the patent, lines 4 to 9, the composition was satisfactory in producing a sintered slug one-half inch thick. However, it was subsequently found that, in producing large sizes for use in dies, for example, sizes of about one and one-half inches square and larger, the finally sintered product tended to be porous. In addition, the transverse rupture strength was not all that was desired, the transverse rupture ranging from about 220,000 psi to 250,000 psi.

Another embodiment of a steel-bonded carbide is disclosed in U.S. Pat. No. 3,809,540 (also assigned to the present assignee) in which the composition comprises primary grains of titanium carbide dispersed through a steel matrix containing limited amount of nickel ranging from about 0.1% to 1% by weight of the matrix composition. However, a limitation of the foregoing carbide composition is that it does not have the capability of resisting softening at temperatures above about 950° F. or 1000° F. (510° C. or 538° C.) in hot working applications conducted at relatively high hot working temperatures.

Reference is further made to U.S. Pat. No. 3,369,891 (also assigned to the present assignee) which is directed to a titanium carbide tool steel in which the steel matrix contains by weight about 10% to 30% nickel, about 0.2 to 9% titanium, up to about 5% aluminum, the sum of the titanium and aluminum not exceeding about 9%, up to about 25% cobalt, up to about 10% molybdenum, with substantially the balance at least about 50% iron. This alloy is produced by sintering and is solution annealed at a temperature of about 760° C. to 1165° C. (1400° F. to 2150° F.) followed by air cooling. For example, an alloy containing 21.7% Ni, 8.49% Co, 3.42% Mo, 0.37% Ti and the balance iron exhibited a hardness not exceeding 50 $R_C$ after heating at 815° C. (1500° F.) for 30 minutes and then cooling to ambient temperature.

The microstructure of the foregoing annealed alloy is soft martensite which can be age hardened to 60 $R_C$ and above by heating to a temperature in the range of about 260° C. to 650° C. (500° F. to 1200° F.) for about 3 hours and then air cooling, the low temperature being advantageous in that substantially close dimensional tolerances can be maintained with intricate shapes and cracking greatly inhibited.

However, the aforementioned titanium carbide tool steel has its limitation as a high temperature working tool in that the age-hardened tool tends to soften at elevated temperatures above 1200° F. (650° C.).

Tooling and component part manufacturers have been constantly seeking newer and better die materials capable of withstanding stresses, thermal shock, impact, heat and wear encountered in certain hot work and impact-involving applications, including such die elements as warm heading dies, swedging dies, forging dies, die casting tools, and the like. This demand has created an urgent need for steel-bonded titanium carbide die material having a unique combination of physical and mechanical properties at room and elevated temperatures, particularly improved resistance to impact and improved resistance to thermal shock.

OBJECTS OF THE INVENTION

It is thus the object of the invention to provide a titanium carbide tool steel composition having improved resistance to impact and improved resistance to thermal shock.

Another object is to provide as an article of manufacture, a hardened wear resistant die element characterized by a high degree of resistance to wear, in combination with improved physical and mechanical properties and improved resistance to thermal shock.

These and other objects will more clearly appear from the following disclosure and the appended claims.

STATEMENT OF THE INVENTION

One embodiment of the invention resides in a sintered age-hardenable titanium carbide tool steel composition having particular use as a hardened die element in hot working applications, said composition comprising by volume about 15% to 50% primary grains of titanium carbide dispersed through a high cobalt-containing steel matrix making up essentially the balance (85% to 50%), said steel matrix consisting essentially by weight about 10% to 25% cobalt, aobut 5% to 20% chromium, about 0.5% to 5% molybdenum, 0 to 2% nickel, 0 to 0.15% carbon and essentially the balance at least about 50% iron.

A preferred composition is one containing by volume about 30% to 50% TiC with the steel matrix making up essentially the balance (70% to 50%), the steel matrix consisting essentially by weight of about 15% to 25% cobalt, about 10% to 20% chromium, about 1% to 4% molybdenum, carbon less than about 0.1% and essentially the balance at least about 50% iron.

The foregoing compositions are particularly applicable as die elements or tools under aggravating high temperature conditions involving high pressure, wear by abrasion, thermal shock, and other conditions which prevail at elevated hot working temperatures and pressures. Thus, hot working die elements or tools should possess, among other properties, resistance to thermal shock, good ductility, notch toughness, high strength at elevated temperatures and good resistance to wear. In addition, and very importantly, it should have adequate hot hardness to resist deformation in service.

The present invention fulfills the foregoing requirements and finds use as die material in such areas as hot forging, hot extrusion, hot rolling and also as dies in the die-casting industry.

A particular specific sintered composition is one containing 40% volume of TiC (about 30% by weight) dispersed through a steel matrix making up essentially the balance (60% by volume or about 70% by weight), the steel matrix consisting essentially by weight based on the total weight of the matrix of about 20% cobalt, about 15% chromium, about 2.9% molybdenum, about 0.2% nickel, 0.02 maximum carbon and the balance essentially iron (e.g. 61.9%).

The foregoing sintered composition is produced as follows.

About 1000 grams of titanium carbide powder of about 5 to 7 microns average size are mixed with 2330 grams of steel-forming ingredients of the foregoing composition of 20 microns average size in a steel ball mill (stainless steel balls). To the mix is added one gram of paraffin wax for each 100 grams of mix. The milling is conducted for about 40 hours with the mill half-full of steel balls of about one-half inch in diameter using hexane as the vehicle.

After completion of the milling, the mix is removed and vacuum dried. A predetermined amount of the mixed powder is compressed in a die at about 15 tons per square inch (tsi) to the desired shape. The shape is liquid phase sintered, that is, sintered above the melting point of the matrix composition, at a temperature of about 1435° C. for one hour in vacuum, e.g., a vacuum corresponding to 20 microns of mercury or better. After completion of sintering, the shape is cooled to ambient temperature. The as-sintered hardness was about 50 $R_C$.

The sintered part was subjected to a solution heat treatment at 1750° F. (955° C.) for one hour, cooled to ambient temperature and then age hardened at 1050° F. (565° C.) for four hours. The properties of the part in the age hardened condition are given below.

| Material | T.R.S. P.S.I. | Impact Strength in lb/in$^2$ | Density gr/cc | Hardness Solutionized 1750° F.-1 hr. | Hardness Aged 1050° F.-4 hrs. |
|---|---|---|---|---|---|
| Invented alloy with the preferred matrix composition | 275,000 | 654 | 6.69 | 44 $R_c$ | 56 $R_c$ |

Broadly, the heat treatment of the tool steel composition of the invention comprises solution treating at a temperature ranging from about 1650° F. to 2100° F. (about 900° C. to 1150° C.), preferably 1700° F. to 1800° F. (about 925° C. to 985° C.), for at least one-quarter or an hour. Generally speaking, the part is maintained at the solution temperature for one hour for each inch thickness of cross section. Following heating at the solution temperature, the part is cooled at a rate of about 15° C. per hour to about 100° C.

The solution-treated part is then age hardened at a temperature within the range of about 900° F. to 1200° F. (about 480° C. to 650° C.) and preferably from about 1000° F. to 1100° F. (about 535° C. to 595° C.) for about one to ten hours.

The presence of relatively high amounts of cobalt in the composition assures a desired level of hot hardness when the composition is employed as a die element at elevated hot working temperatures, such as prevail in hot forging and hot extrusion operations, the composition having a high resistance to thermal cracking.

In this connection, thermal shock tests were carried out comparing the titanium carbide tool steel of the invention with other tool steel compositions as follows:

(1) 30 wt.% TiC (about 40 vol.%) and 70 wt.% steel matrix (about 60 vol.%); the steel matrix containing by weight 20% Co, 15% Cr, 2.9% Mo, 0.2% Ni, 0.02% max C and the balance essentially iron.

(The Invention)

(A) 34% wt.% TiC-67 wt.% steel matrix; the steel matrix containing 10% Cr, 3% Mo, 0.85% C and the balance essentially iron.

(U.S. Pat. No. 3,653,982)

(B) 25 wt.% TiC-75 wt.% steel matrix; the steel matrix containing 5% Cr, 4% Mo, 0.5% Ni, 0.4% C and the balance essentially iron.

(U.S. Pat. No. 3,809,940)

The foregoing compositions were produced by sintering as similarly described herein for the titanium carbide tool steel alloy of the invention. All of the compositions were compared in the hardened state using the following thermal shock test.

The resistance to thermal shock is conducted by repeatedly heating rectangular ground pieces of approximately 1 inch×1 inch×¼ inch in size to 1500° F. (815° C.) and quenching into oil maintained at room temperature. The heating and quenching cycle is repeated until thermal cracks are formed. The number of cycles before cracking sets in is taken as a measure of resistance to thermal shock. The results obtained are as follows:

| Material Tested | Number of Cycles Sustained Before Thermal Cracking Occurred |
|---|---|
| (A) | 2 |
| (B) | 15 |
| (1) Invention | 33 |

As will be clearly apparent, the composition of the present invention shows an unexpected improvement in resistance to thermal shock as compared to materials (A) and (B).

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A sintered age-hardenable titanium carbide tool steel composition comprising by volume about 15% to 50% primary grains of titanium carbide dispersed through a high cobalt-containing steel matrix making up the balance and consisting essentially by weight of about 10% to 25% cobalt, about 5% to 20% chromium, about 0.5% to 5% molybdenum, 0 to 2% nickel, 0 to 0.15% carbon and essentially the balance at least about 50% iron.

2. The sintered age-hardenable titanium carbide tool steel composition of claim 1, wherein the titanium carbide ranges by volume from about 30% to 50% with the steel matrix making up the balance, said steel matrix consisting essentially by weight of about 15% to 25% cobalt, about 10% to 20% chromium, about 1% to 4% molybdenum, carbon less than about 0.1% and essentially the balance at least about 50% iron.

3. As an article of manufacture, a die element made of an age-hardened titanium carbide tool steel composition comprising by volume about 15% to 50% primary grains of titanium carbide dispersed through a high cobalt containing steel matrix making up the balance and consisting essentially by weight of about 10% to 25% cobalt, about 5% to 20% chromium, about 0.5% to 5% molybdenum, 0 to 2% nickel, 0 to 0.15% carbon and essentially the balance at least about 50% iron.

4. The article of manufacture of claim 3, wherein the titanium carbide ranges by volume from about 30% to 50% with the steel matrix making up the balance, said steel matrix consisting essentially by weight of about 15% to 25% cobalt, about 10% to 20% chromium, about 1% to 4% molybdenum, carbon less than about 0.1% and essentially the balance at least about 50% iron.

* * * * *